US005882215A

United States Patent [19]

Burns

[11] Patent Number: 5,882,215

[45] Date of Patent: Mar. 16, 1999

[54] TERMINATING COAXIAL CABLE APPARATUS

[75] Inventor: Joseph D. Burns, Parker, Colo.

[73] Assignee: ICG Technology, LLC, Phoenix, Ariz.

[21] Appl. No.: 686,383

[22] Filed: Jul. 25, 1996

[51] Int. Cl.[6] ..... H01R 13/44

[52] U.S. Cl. ..... 439/142

[58] Field of Search ..... 439/133, 136, 439/142, 144, 620, 509

[56] References Cited

U.S. PATENT DOCUMENTS

| | | | |
|---|---|---|---|
| 2,965,858 | 12/1960 | Palmer et al. | 333/22 |
| 3,525,056 | 8/1970 | Qurashi | 333/22 |
| 3,768,063 | 10/1973 | Coffman | 439/135 |
| 3,784,950 | 1/1974 | Coffman | 338/220 |
| 3,873,785 | 3/1975 | Lieberman | 200/51.1 |
| 4,640,575 | 2/1987 | Dumas | 385/134 |
| 4,660,921 | 4/1987 | Hauver | 439/578 |
| 4,971,569 | 11/1990 | Gooch et al. | 439/188 |
| 5,030,122 | 7/1991 | Birch et al. | 439/188 |
| 5,073,122 | 12/1991 | Birch | 439/188 |
| 5,076,797 | 12/1991 | Moulton | 439/188 |
| 5,090,915 | 2/1992 | Moulton | 439/188 |
| 5,237,293 | 8/1993 | Kan et al. | 333/22 R |
| 5,321,203 | 6/1994 | Goto et al. | 439/509 |
| 5,340,325 | 8/1994 | Pai | 439/188 |
| 5,399,103 | 3/1995 | Kuboshima et al. | 439/509 |

*Primary Examiner*—Neil Abrams
*Assistant Examiner*—Barry M. L. Standig
*Attorney, Agent, or Firm*—William J. Hallihan; Steven G. Lisa

[57] ABSTRACT

A "terminating" coaxial cable connector apparatus includes an electronic terminating circuit that approaches the characteristic impedance of the coaxial cable system. The terminating circuit is mounted in or on a housing that is connected to a wall mounting plate and is external to the cable connector. The electronic terminating circuit is structured so that it can be moved to a first position which electronically decouples the electronic circuit from the coaxial cable. In that first position a standard mating connector can then be connected to the standard cable jack. In a second position, the terminating circuit contacts and electrically couples the central coaxial conductor and the cylindrical conductive housing of a standard open coaxial connector. A frictional surface is provided on the housing to allow the housing to be gripped and moved between the first and second positions.

26 Claims, 7 Drawing Sheets

TERMINATING COAXIAL CABLE APPARATUS

FIELD OF THE INVENTION

This invention relates to electrical connectors, particularly to an apparatus for terminating coaxial connectors mounted on a wall, or the like.

BACKGROUND OF THE INVENTION

Large numbers of homes are wired for cable TV. The characteristic impedance of the coaxial cable used in such a system is typically 75 ohms. In these cable systems, all coaxial cable, active and passive electronic devices used in the system are designed to function with an electrical impedance of 75 ohms.

Cable systems are typically constructed to allow for a coaxial cable connection to cable subscribers. These systems use standard coaxial cables having a cylindrical conductive housing or shield as a first circuit path, and a coaxial center conductor as a second circuit path. A single cable is typically run to each home or apartment, and then an internal splitter is used to allow for multiple "outlets" or coaxial cable jacks that are usually mounted in wall plates. To use a particular coaxial outlet or jack, a coaxial cable having a mating male connector is run from the wall jack to a television set or VCR. However, it is not uncommon for one or more of the jacks to be left "open" or uncoupled to a TV, VCR, or other electronic device.

When a coaxial connector or jack is left "open" or unconnected, the uniform impedance characteristics of the cable system are disturbed, causing undesirable reflection and radiation of electrical signals into and out of the center connector. Such undesirable signals are introduced back down the cable, and are sometimes seen as "ghosts" on the television. While spurious signals rarely become a critical problem for cable television systems, these undesirable signals are critical when the cable system is used for telephone or digital data communication. Specifically, if any of the coaxial cable jacks in the house are left open, significant errors can occur in modem or other telephone data communications that take place over the cable system.

One solution has been to provide a "self-terminating" coaxial connector or jack to reduce signal problems induced through open cable jacks. Such "self-terminating" coaxial connectors can be switched to a "terminated" condition when the coaxial cable jack is left open or uncoupled. A terminated condition exists when the center conductor of the coaxial cable jack is connected to its conductive shield through a termination circuit element having the same or approaching the same characteristic impedance as the coaxial connector and cable, which for most cable system is 75 ohms. Thus, in many "self-terminating" cable connectors a 75 ohm resister connects the center conductor and the cylindrical conductive housing when the connector is left uncoupled.

Several versions of "self-terminating" cable connectors or jacks are known to exist. Usually, an internal switching arrangement is provided in the cable connector so that the two circuit paths of the coaxial cable are connected by a terminating resistance when the jack is left uncoupled. In that way, the end of the line is not allowed to remain in an open state. Exemplary coaxial cables and terminating connectors are described in various references, including U.S. Pat. Nos. 2,965,858; 3,525,056; 3,768,063; 3,784,950; 3,873,785; 4,660,921; 4,971,569; 5,030,122; 5,073,123; 5,076,797; 5,090,915; 5,237,293; and 5,340,325, each of which is incorporated herein by reference.

Previous efforts using "self-terminating" connectors have suffered from problems associated with the internal switching arrangements used to terminate the circuits. In "self-terminating" connectors, the terminating resistance must be connected between the outer housing and the central conductor at a position such that they do not interfere with the insertion of a cooperating male coaxial connector. Often as a consequence of this, when the male connector is withdrawn and the self-terminating resistance is connected, a small unconnected portion of the central connecting stub remains beyond the point where the terminating resistance is connected. In such devices, it is impossible to avoid a certain amount of capacitive coupling between this dead end stub portion and the outer cylindrical housing. Further, the stub reflects energy back down the line, which is a deficiency for the telephone industry, which often operate above 60 megahertz.

Another disadvantage of many of the existing "self-terminating" cable connectors is that they often require the use of custom female connectors or jacks. However, the vast majority of cable-ready homes throughout the country do not have the custom female connectors or coaxial cable jacks installed at the outlet wall plates, but rather, use a standard cable jack. Accordingly, to convert existing standard configurations to the custom connections and jacks required by many of the known forms of self-terminating connectors would require many man-hours unscrewing wall plates, disconnecting the coaxial cable jack from the wall plate, disconnecting the jack from the cable located inside the wall, connecting a new custom "self-terminating" female jack, and reassembling the components. Furthermore, replacement of the standard female connector with custom "self-terminating" female jacks could also require cable companies and consumers to replace or purchase an associated adapter for the corresponding custom male connectors.

Yet another disadvantage with prior "self-terminating" connectors is that the "switch" used to provide the terminating resistance is internal. Over time, the moving parts of the internal "switch" can wear and become inoperative. Replacing these worn connectors would also require the removal of the wall plate from the wall, disconnecting the coaxial cable jack from the wall plate, disconnecting the jack from the cable located within the wall, replacing a new jack on the cable and reassembling the components.

Another solution to the "open" jack problem had been to install an easily removable "terminating" endcap on any cable jacks that were not in use. Such "terminating" endcaps are also designed to provide a terminating resistance between the two circuit paths of the coaxial cable when the endcaps are connected to the cable jack. A homeowner must remove the endcap from the jack whenever they want to connect a cable thereto. These endcaps must also be replaced by the homeowner whenever the cable is removed from the jack to prevent an "open" situation from occurring. Additionally, these endcaps are often lost or misplaced when they are removed from a jack. In other cases, the person removing a cable from the jack either does not know, or forgot that the endcap should be replaced. As a result, jacks are often left in an "open" condition, even when the "terminating" endcaps were previously provided. Often the replacement costs for lost and misplaced endcaps and the cost in man-hours to remind homeowners to use the endcaps can become burdensome.

The present invention overcomes the above disadvantages without departing from the standard coaxial cable configuration by providing a connecting outlet in which the voltage standing wave ratio (VSWR) is maintained very close to unity so as to virtually eliminate reflection of spurious signals from the connector outlet. An apparatus is provided to "terminate" or "close" the cable jack with a "terminating resistance" applied at the very end of and external to the cable, thereby eliminating any unconnected portions of the central conductive circuit path. Even when the "terminating resistance" is removed from the jack, the apparatus cannot be lost or misplaced because the apparatus is attached to a wall plate or other location proximate to the cable jack. Additionally, since the apparatus is located near the jack, the apparatus acts as a reminder to replace the apparatus when the jack is not in use. In some forms, the apparatus even acts as a "self-terminating" connection. The present invention is compatible with existing standard coaxial cable jacks and connectors allowing the invention to be used with existing cable systems. Retrofitting such a system merely requires the replacement of the standard wall mounting plate, or the addition of a piece external to the wall mounting plate. Furthermore, all moving parts are external to the cable connector. Most repairs would merely require exchanging a piece that is external to the wall mounting plate.

SUMMARY OF THE INVENTION

It is an object of the invention to provide an improved "terminating-resistance" for a coaxial cable connector that is not easily lost or misplaced.

Another object of the invention to provide an improved "terminating-resistance" for a coaxial cable connector that is convenient to use.

Another object of the invention to provide an improved "terminating-resistance" for a coaxial cable connector that is conveniently located and easy to use.

Another object of the invention to provide an improved "terminating-resistance" for a coaxial cable connector that is located proximate to a coaxial cable jack to act as a reminder that the jack should not be left in an "open" state.

Another object of the invention to provide an improved "self-terminating" coaxial cable connector that is compatible with existing coaxial cable connectors.

Another object of the invention is to provide a low cost "self-terminating" coaxial cable connector that is easily installed in existing cable systems.

Another object of the invention is to provide a "self-terminating" coaxial cable connector that is easy for consumers to use.

Another object of the invention is to provide a "self-terminating" coaxial cable connector that is easily replaced.

Another object of the invention is to provide a "self-terminating" coaxial cable connector that may easily be inspected for damage to the "self-terminating" component.

Another object of the invention is to provide a "self-terminating" coaxial cable connector that does not have a dead end stub portion that reflects energy back down the coaxial cable.

Another object of the invention is to provide a "self-terminating" coaxial cable connector without an internal switching arrangement that may wear out over time.

Another object of the invention is to provide a "self-terminating" coaxial cable connector that does not require an adapter to be coupled with a standard connector.

Another object of the invention is to provide a "self-terminating" coaxial cable connector that may be easily connected to a mating male connector and provides a simple method of self-terminating the connection when the mating male connector is removed.

The above and further objects of the invention are achieved through the provision of an apparatus that is mounted external to a coaxial cable connector and that acts to "terminate" the connector. The "terminating" apparatus is mounted proximate to the cable jack, such as to the wall plate, and includes a terminating circuit that approaches the characteristic impedance of the coaxial cable and connector. The terminating circuit can be manually placed in a position to contact the coaxial connector, and is structured to electrically couple and provide a terminating resistance between the central coaxial conductor and the cylindrical conductive housing of the coaxial connector.

The above and other objects are further achieved through the provision of an apparatus that is mounted external to a coaxial cable connector and that acts to "self-terminate" the connector. The "self-terminating" coaxial cable connector apparatus includes a terminating circuit that is movably connected to a standard coaxial cable wall mounting plate. The terminating circuit is biased in a normal position to contact the coaxial connector, and is structured to electrically couple and provide a terminating resistance between the central coaxial conductor and the cylindrical conductive housing of the coaxial connector.

The above and other objects are further achieved by the provision of "self-terminating" coaxial cable connector apparatus that is hingedly connected to a coaxial cable wall mounting plate and includes a terminating resistor that approaches the characteristic impedance of the coaxial cable and connector. The resistor is structured to electrically couple the central coaxial conductor and the cylindrical conductive housing of the coaxial connector and is biased in a position to contact the coaxial connector.

The above and other objects are further achieved by the provision of "self terminating" coaxial cable connector apparatus that includes an electronic terminating circuit that approaches the characteristic impedance of the coaxial cable and connector. The terminating circuit is mounted in or on a housing that is coupled to a standard wall mounting plate. The electronic terminating circuit is structured so that it can be moved to a first position which causes the electronic circuit to electronically decouple from the coaxial cable. In that first position, standard external components, such as a television or VCR, can then be connected to the female cable jack. In a second position, the terminating circuit is caused to contact and electrically couple the central coaxial conductor and the cylindrical conductive housing of a standard open coaxial connector or jack. A frictional surface is provided on the housing to allow the housing to be gripped and moved between the first and second positions.

A preferred embodiment of the inventions is described below in the Figures and Detailed Description. Unless specifically noted, it is applicant's intention that the words and phrases in the specification and claims be given the ordinary and accustomed meaning to those of ordinary skill in the applicable art(s). If applicant intends any other meaning, he will specifically state that he is applying a special meaning to a word or phrase.

Likewise, applicant's use of the word "function" in the Detailed Description is not intended to indicate that he seeks to invoke the special provisions of 35 U.S.C. Section 112, ¶6 to define his invention. To the contrary, if applicant wishes to invoke the provisions of 35 U.S.C. Section 112, ¶6, to define his invention, he will specifically set forth in the claims the phrases "means for" or "step for" and a function, without also reciting in that phrase any structure, material or act in support of the function. Even if applicant recites in his claims a "means for" or "step for" performing a function, if he also recites structure, material or acts in support of that function, then it is his intent not to invoke the provisions of 35 U.S.C section 112, ¶6. Moreover, even if applicant invokes the provisions of 35 U.S.C. Section 112, ¶6 to define his invention, it is applicant's intention that his inventions not be limited to only the specific structure, material or acts that are described in his preferred embodiments. Rather, if applicant claims his invention by specifically invoking the provisions of 35 U.S.C. Section 112, ¶6, it is nonetheless his intention to cover and include any and all structures, materials or acts that perform the claimed function, along with any and all known or later developed equivalent structures, materials or acts for performing the claimed function.

DESCRIPTION OF A PREFERRED EMBODIMENT

Figure 1C:
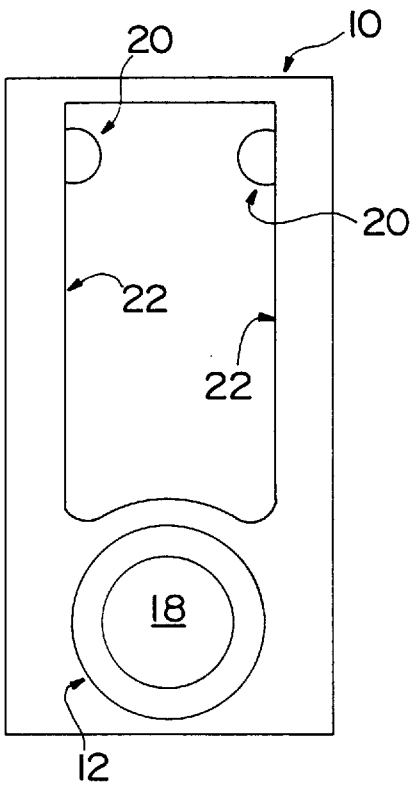
FIG. 1*c* is a interior view of the shield cover of FIG. 1*a*.
Figure 1B:
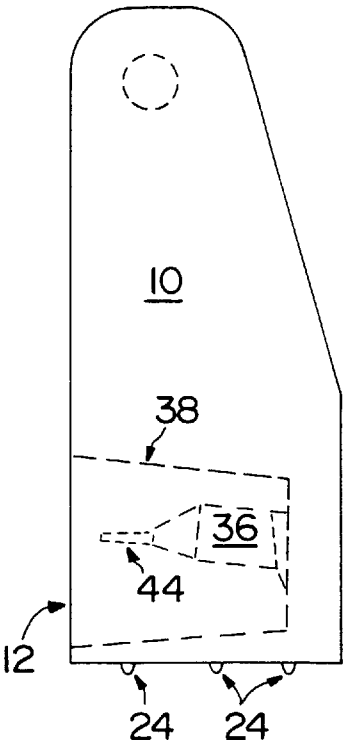
FIG. 1*b* is a side view of the shield cover of FIG. 1*a*.
Figure 1A:
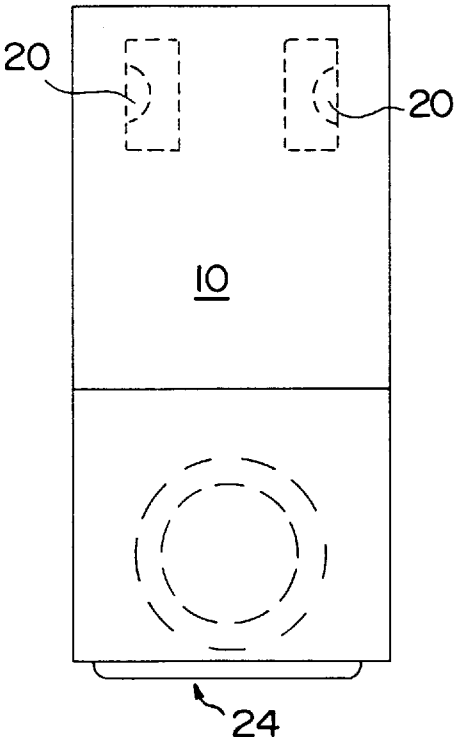
FIG. 1*a* is a plan view of a shield cover used in one embodiment.

FIGS. 1*a*, 1*b*, and 1*c* show a terminating circuit support housing 10 that is configured with a hollow area 12 in which a terminating circuit 14 (shown in FIG. 3) is retained. The circuit support housing 10 is mounted on a cable wall plate 16 (shown in FIG. 2) so that it can be raised and lowered. In its preferred form, the circuit support housing 10 is hingedly mounted to the wall plate 16. As discussed in greater detail below, when the components are assembled as shown in FIGS. 4*a* and 4*b*, the support housing 10 can be selectively placed in either of two positions. In a first "non-terminating" position, the support housing 10 is pivoted upwards and the cable jack or connector 17 (shown in FIG. 4*a*) is left open, thereby allowing connection of an external component such as a television or cable box (not shown). In a second "self-terminating" position, the support housing 10 with its associated terminating circuit 14 is pivoted down to cover and electrically terminate the cable connector 17.

Referring again to FIGS. 1*a*, 1*b* and 1*c*, the hollow area 12 of housing 10 includes a mounting surface 18 on which the terminating circuit 14 is mounted. Any and all applicable securing systems or methods can be used to retain the circuit 14 within the housing 10. For example, the circuit 14 can be welded, riveted, glued, press fit, or otherwise secured or fastened within the hollow area 12 of housing 10. Alternatively, the circuit 14 can be formed separately from the housing 10, and then attached to a receptacle (not shown) in the housing 10. Thus, this invention is not limited to any particular means, system or method for securing or retaining the circuit 12 on the housing 10. Rather, it is important only that circuit 12 be securely formed with or coupled to housing 10 in a manner so that it can be moved to a terminating position as shown in FIG. 4.

The circuit support housing 10 also includes posts 20 that extend from interior walls 22. The posts 20 comprise part of a hinge-like coupling between the housing 10 and wall plate 16 (of FIGS. 2*a* and 2*b*), as described further below. A frictional gripping surface, such as ribs 24, are provided along at least one side of the exterior of the housing 10. Ribs 24 enable housing 10 to be easily gripped and moved between the first and second positions when housing 10 is connected to mounting plate 16. Again, it is not critical how the housing 10 is actually coupled to the wall plate 16. Any form of moveable coupling can be used. In its simplest form, the housing 10 can be coupled to the wall plate 16 by a simple string or cable (not shown) that is fastened at one end to the plate 16 and at the other end to the housing 10. In this latter configuration, the housing 10 is left to dangle or hang by the connecting string when it is not in a self-terminating position. To emphasize that the broad scope of the invention is not limited to any particular structure or material for movably coupling the housing 10 to the plate 16, several additional embodiments are presented in FIGS. 5 through 7.

Figure 2A:
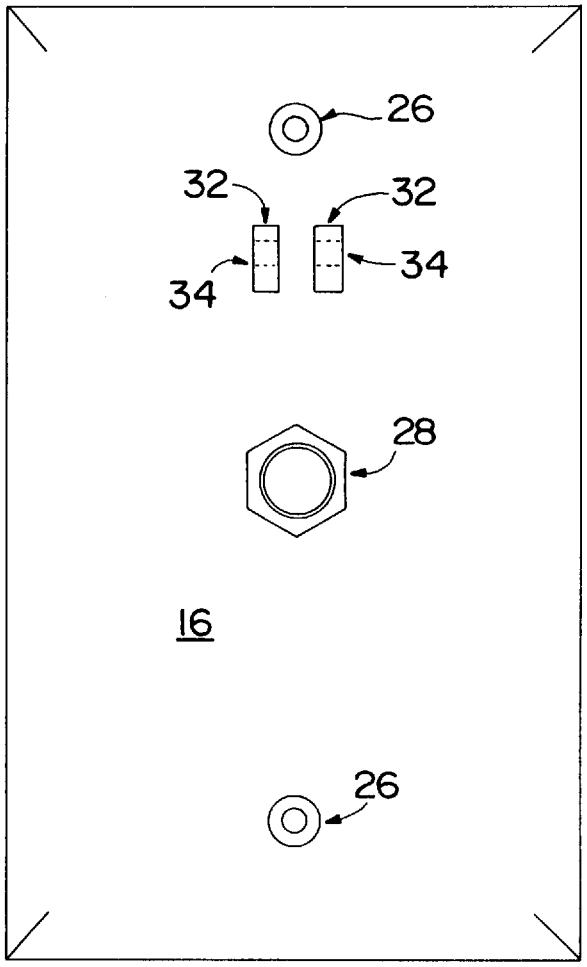
FIG. 2*a* is a plan view of a cable wall plate utilized in one embodiment.
Figure 2B:
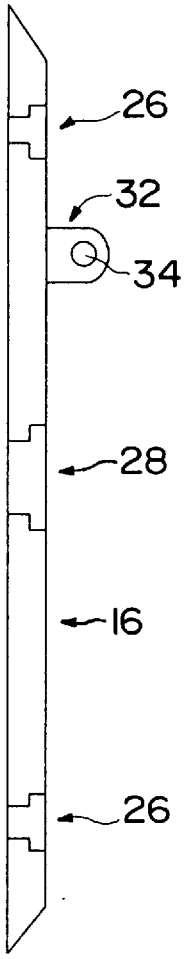
FIG. 2*b* is a side view of the cable wall plate of FIG. 2.

FIGS. 2*a* and 2*b* show a preferred form of the coaxial cable connector mounting or wall plate 16. The mounting or wall plate 16 includes screw recesses 26 to allow the plate 16 to be secured to a wall or other suitable surface (not shown). A hex nut 28 is provided near the center of the plate 16, and is used to connect a cable connector or jack 17 as shown in FIGS. 4*a* and 4*b*. Mounting tabs 32, which can be molded as part of wall mounting plate 16, are used as part of the hinge-like coupling between housing 10 (of FIG. 1) and wall mounting plate 16. In a preferred form of the invention, tabs 32 are provided with openings 34 that are sized to allow posts 20 of housing 10 to snap-fit and rotate therein, as shown in FIGS. 4*a* and 4*b*.

Again, although cooperating tabs 32 and posts 20 are shown as a preferred form of the hinged coupling between the housing 10 and the plate 16, other forms can be substituted. For example, an axle pin (not shown) can be substituted for the posts 20, and holes (not shown) can be formed in the housing 10. The holes in the housing 10 can be aligned with the openings 34 in the tabs 32, and the axle pin fit therethrough. Thus, the invention should not be limited to the specific form of the preferred embodiment for coupling the housing 10 to the plate 16.

Figure 3A:
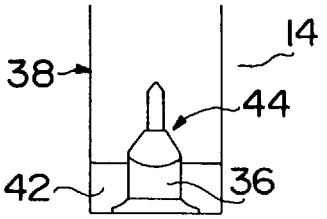
FIG. 3*a* is a partial cutaway view of a terminating resistive circuit.
Figure 3B:
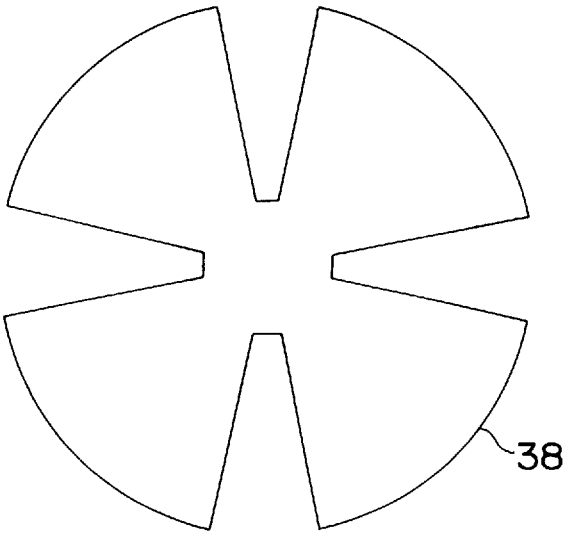
FIG. 3*b* is a plan view of the sheet stock used to make a conductive shield in the resistive circuit in FIG. 3*a*.
Figure 3C:
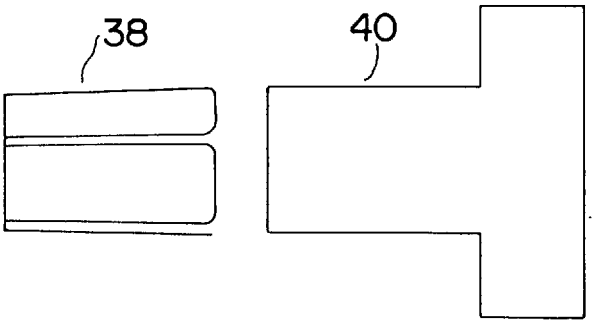
FIG. 3*c* is a side view of a conductive shield and the stamping tool that forms the conductive shield from the sheet stock of FIG. 3*b*.

FIGS. 3*a*, 3*b* and 3*c* show a preferred form of the terminating circuit 14 carried by housing 10 and used to create a terminated condition in the cable connector jack 17 of the coaxial cable system. A terminating resistor 36 is carried in and electrically contacted with a conductive shield 38. The conductive shield 38 is in turn affixed to the housing 10 within the hollowed region 12, using, for example, mounting surface 18. When the housing 10 is moved into a terminating position as shown in FIG. 4*a*, the resistor 36 is inserted into the female cable jack 17. At the same time, the conductive shield 38 contacts the cylindrical conductive housing of the coaxial cable jack 17. Thus, a circuit showing an impedance determined by the resistor 36 is formed between the center conductor of the conductive housing of the female coaxial cable jack 17.

A preferred construction of the conductive shield 38 is best understood with reference to FIGS. 3*b* and 3*c*. In its preferred form, the conductive element 38 is stamped from a thirty-gauge sheet of tin or aluminum. A suitable configuration for the pre-stamped sheet-stock used to make the conductive shield 36 is shown more clearly in FIG. 3*b*. In its preferred embodiment, the conductive shield 36 is pressed into a cup-like shape, using a stamp tool 40 shown in FIG. 3*c*. By pressing the flat cut piece of FIG. 3*b* over the stamp tool 40 of FIG. 3*c*, the shield 38 is formed into the cup-like cylindrical shape. The conductive element or shield 38 is then fixed within the hollow region 12 of the housing 10. If desired, the cup-like shape of the shield 38 can be tapered outward to more easily fit over the female coaxial jack 17. The purpose of the shield 38 is to form a contact with the cylindrical conductive housing of a standard female coaxial jack 17, as shown in FIG. 4*a*.

Referring again to FIG. 3*a*, the terminating circuit 14 includes a 75 ohm resistor 36 that is soldered to the conductive shield 38. An epoxy filler 42 is then used to strengthen and protect the connection between the resistor 36 and the conductive shield 38. The resistor 36 has its other end electrically coupled to a contact 44, such as a 18 gauge tinned crimp-on tip. The terminating circuit 14 is designed to provide a terminated condition, at a coaxial cable jack, by electrically coupling together the cylindrical conductive housing and the coaxial center of a standard coaxial jack 17 through conductive shield 38, resistor 36, and electrical contact 44.

Although a preferred embodiment for the electrical circuit 14 is shown, other circuits and arrangements can be substituted. For example, any electrical device that has the same or approaches the characteristic impedance of the coaxial connector and cable can be substituted for the resistor 36. Likewise, any appropriate system or method can be used to fasten or connect the resistor to the conductive shield 38. Further, any applicable device can be substituted for the tinned crimp-on tip 44, as long as it can be retained on the end of the resistor 36 and will form a contact within the center of the female coaxial jack 17. Indeed, it is possible to configure the resistor 36 so that it includes an integral connection tip 44.

FIGS. 4*a* and 4*b* show the terminating circuit 14 (of FIG. 3) coupled to housing 10 (of FIGS. 1*a*, 1*b*, and 1*c*), which is in turn hingedly coupled to wall plate 16 (of FIGS. 2*a* and 2*b*). As described above, the conductive shield 38 of the terminating circuit 14 is retained within the hollow area 12 of housing 10, for example, at mounting surface 18. Posts 20, of housing 10, are snap-fit into openings 34 provided on mounting tabs 32 (of wall plate 16). Posts 20 are allowed to freely rotate within openings 34, and together they provide a hinge-like connection between housing 10 and wall mounting plate 16. A standard cable connector or jack 17, such as an "F" type barrel connector, is attached through wall mounting plate 16 by the hex nut insert 28 (shown in FIGS. 1*a* and 1*b*). For simplicity, the cable that is normally connected to the interior wall side of cable connector 17 is not shown.

FIG. 4*b* shows the housing 10 placed in a first position which is used to couple a cable 48 from an external device (not shown) to cable connector 17. As shown, ribs 24 provide a frictional surface that can be gripped to move housing 10 against the bias of a spring 46. When so moved, the terminating circuit 14 is uncoupled from cable connector jack 17, resulting in the removal of the terminated condition. When housing 10 is raised in the first position, connector jack 17 is exposed, and a standard mating male cable connector 48, on coaxial cable 50, can then be coupled to connector jack 17. Clearly, it is not material whether housing 10 is mounted above, below or to the side of the cable jack 17. Likewise, use of spring 46 is optional.

Figure 4C:
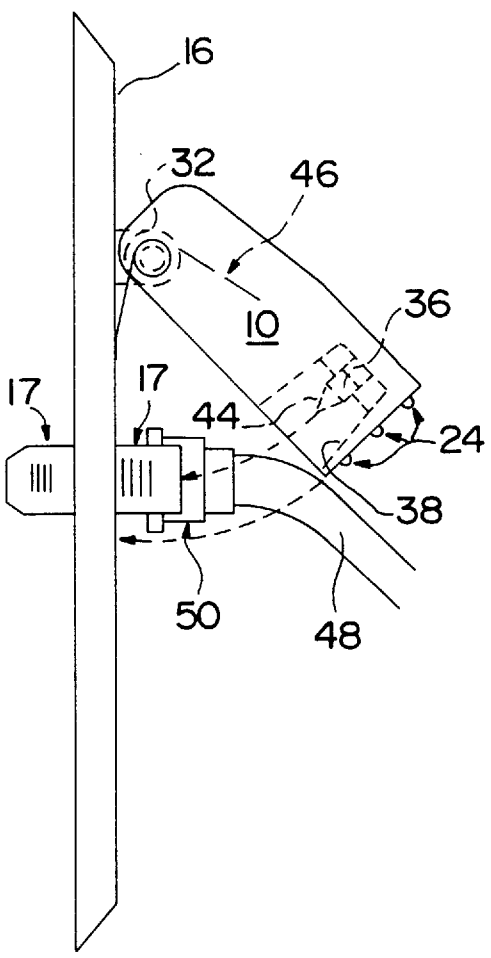
FIG. 4*c* is the same view as FIG. 4*a* with a cable connected to a coaxial cable jack.
Figure 4B:
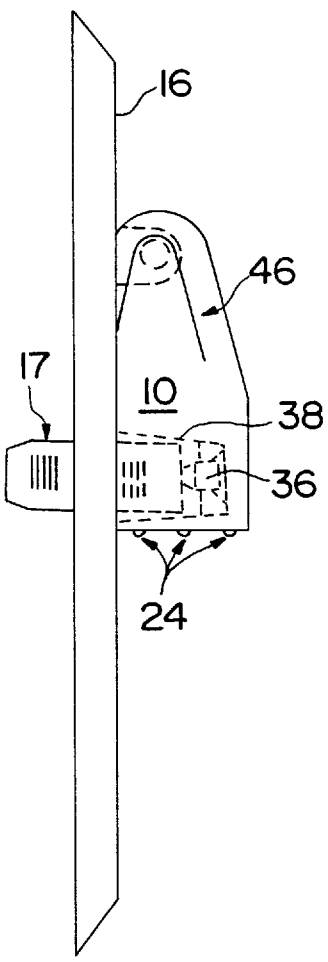
FIG. 4*b* is a side view of FIG. 4*a*.
Figure 4A:
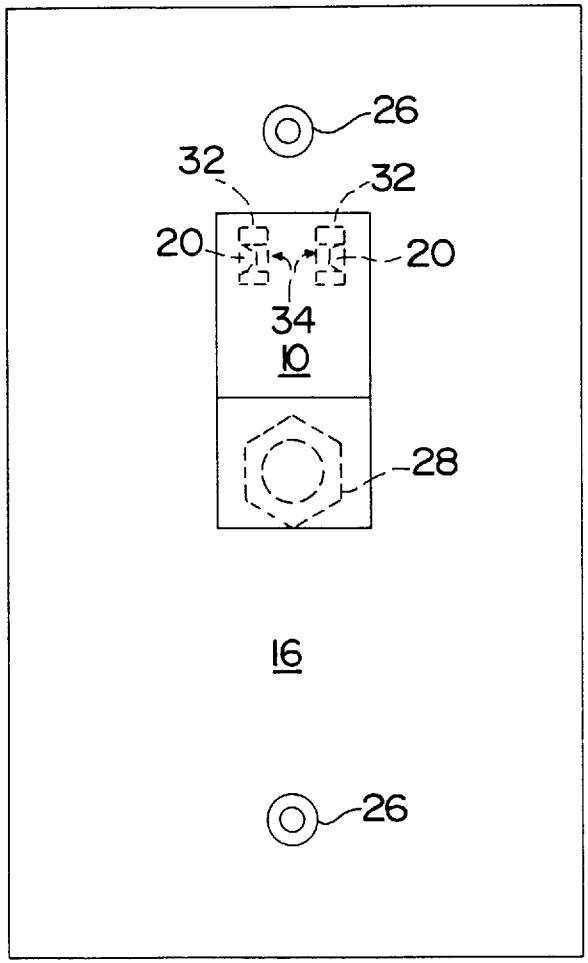
FIG. 4*a* is a plan view of the cable wall plate of FIGS. 2*a* having a cable connector outlet mounted therein and the shield cover of FIGS. 1*a*, including the resistive circuit of FIG. 3, hingedly coupled to the mounting plate.

FIG. 4*c* shows housing 10 biased closed in a second "self-terminating" position by the spring 46. When housing 10 is biased in this position, the respective mating connections of electrical contact 44 and conductive shield 38 of the terminating circuit are in contact with the two electrical paths of the cable connector 17. Electrical contact 44 and conductive shield 38 thereby couple the two electrical paths through resistor 36, resulting in a terminated condition across connector jack 17.

FIGS. 5*a*, 5*b*, 5*c*, 5*d*, 5*e*, 5*f*, and 5*g* show another of the many possible embodiments of the present invention. Details already shown and described in other embodiments are omitted for clarity and to highlight the differences between embodiments. FIGS. 5*a* through 5*g* show a mounting plate or adapter plate 60 that is used to attach circuit support housing 10 to virtually any suitable surface in proximity with cable jack 27. An existing wall plate can provide a suitable surface. The subject adapter plate allows homes to be retrofitted with self-terminating connections without the need for the special wall mounting plate shown in FIGS. 2*a* and 2*b*.

Figure 5A:
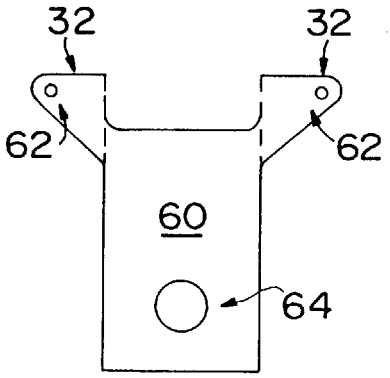
FIG. 5*a* is a plan view of the sheet stock used in making one embodiment of an adapter plate.
Figure 5B:
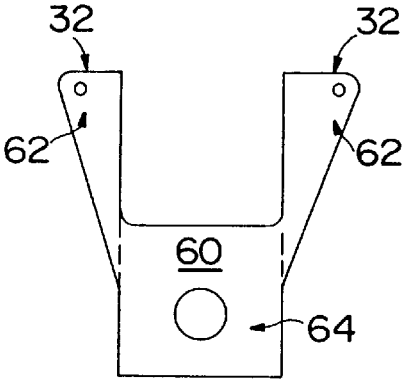
FIG. 5*b* is a plan view of the sheet stock used to make another embodiment of an adapter plate.
Figure 5C:
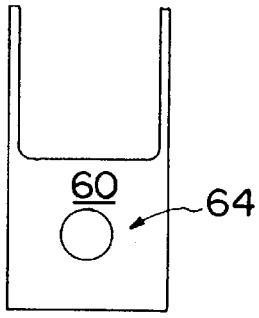
FIG. 5*c* is a plan view of the adapter plate formed from the sheet stock of FIG. 5*b*.
Figure 5D:
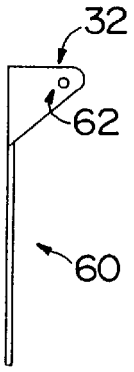
FIG. 5*d* is a side view of the adapter plate formed from the sheet stock of FIG. 5*a*.
Figure 5E:
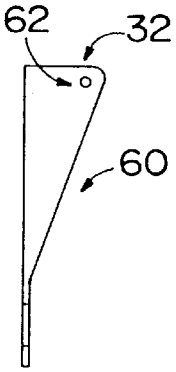
FIG. 5*e* is a side view of the adapter plate of FIG. 5*c*.
Figure 5F:
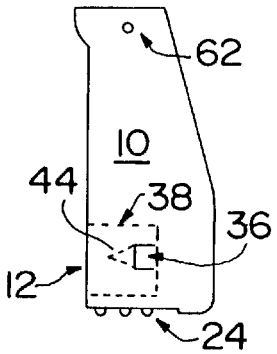
FIG. 5*f* is a side view of a shield cover used in another embodiment of the invention.
Figure 6A:
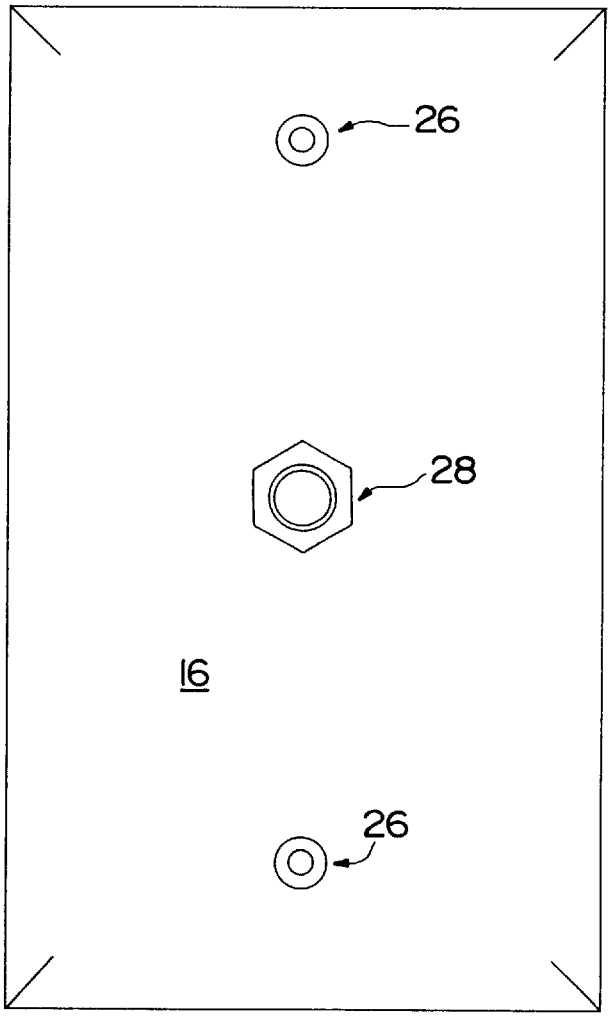
FIG. 6*a* is a plan view of a standard cable wall plate.
Figure 6B:
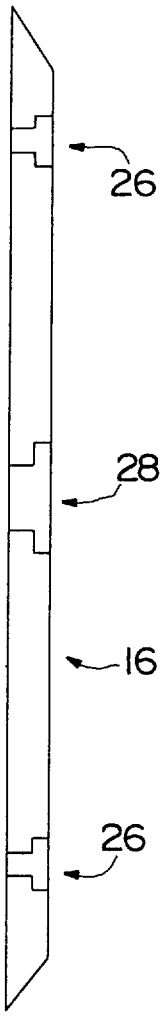
FIG. 6*b* is a side view of the cable wall plate of FIG. 2.

In a preferred form, adapter plate 60 is stamped from a 1/32" or thicker metal sheet-stock in a pattern similar to that shown in FIGS. 5*a* or 5*b*. Adapter plate 60 can be constructed from any suitable material, such as plastics or various metals including brass, aluminum, and copper. Adapter plate 60 can have a variety of alternative shapes and can be formed by a variety of alternative methods as long as adapter plate 60 allows terminating circuit 14 to be hingedly connected to an existing surface close to or part of cable jack 27. At least one mounting tab 32, having pin hole 62, is provided on adapter plate 60. Mounting tabs 32 are bent (along the dotted lines in FIGS. 5*a* or 5*b*) at an angle approximating 90 degrees, as seen in FIGS. 5*c*, 5*d*, and 5*e*. An opening 64, sized to fit cable jack 27, is provided in adapter plate 60. This allows adapter plate 60 to be mounted over jack 27 and attached to wall plate 16.

Opening 64, in adapter plate 60, is placed over the cable connector or jack 27 in mounting plate 16. Hex nut 28 is then screwed on the threaded jack 27 to secure adapter plate 60 to wall plate 16. Alternatively, adapter plate 60 can be fastened to wall plate 16 by another method, such as riveting, gluing, or solvent welding. When adapter plate 60 is fastened to a wall mounting plate 16, the mounting tabs 32, of adapter plate 60, extend outward from wall mounting plate 16 at approximately a 90 degree angle. The mounting tabs 32 are then used to hingedly couple circuit support housing 10 to the wall mounting plate 16 in the manner described below.

Figure 5G:
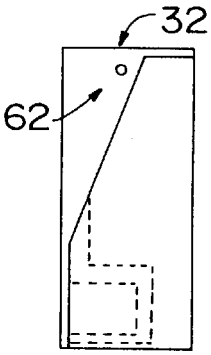
FIG. 5*g* is a side view of a shield cover of FIG. 5*f* coupled to the adapter plate of FIG. 5*e*.

Circuit support housing 10 (see FIGS. 5*g* and 5*f*) is provided with pin holes 62 similar to those provided in mounting tabs 32. This allows circuit support housing 10 to be mounted to adapter plate 60 (as shown in FIG. 5*g*) by aligning the respective pin holes 62 (of circuit support housing 10 and adapter plate 60) and inserting a steel pin (not shown) through the pin holes. This results in a hinge-like connection between terminating circuit 14 and cable jack 27, although other hinge-like connections described in connection with other embodiments of the invention can be substituted. Adapter plate 60 and circuit support housing 10 are sized and positioned so that terminating circuit 14 contacts cable jack 27 to provide a terminating resistance as described above. Furthermore, circuit support housing 10 can be biased in a "closed" position to provide a self-terminating circuit as previously described. The method of operation of this particular embodiment is similar to what has already been shown and discussed, especially with respect to FIGS. 4*a*, 4*b*, and 4*c*.

Figure 7A:
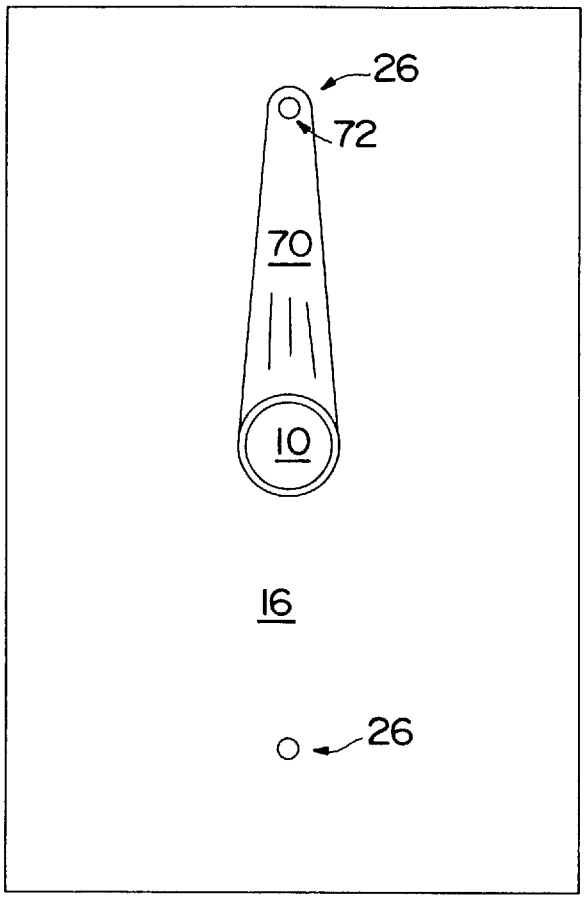
FIG. 7*a* is a plan view of the cable wall plate of FIG. 6*a* having another embodiment of a circuit support housing hingedly connected thereto.
Figure 7B:
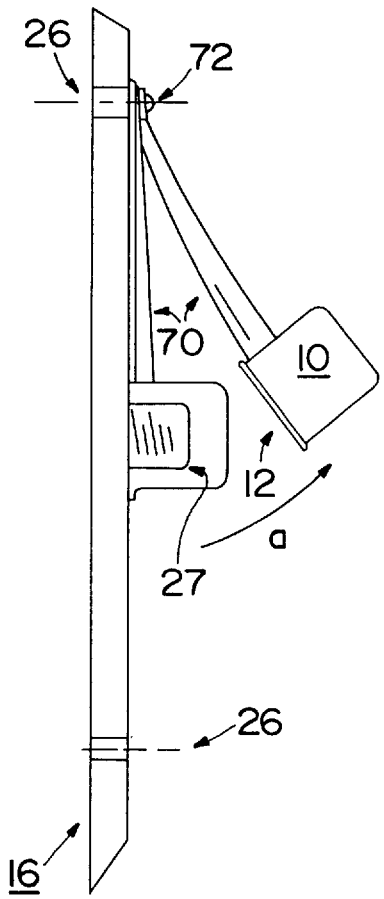
FIG. 7*b* is a side view of the cable wall plate of FIG. 6*b* having another embodiment of a circuit support housing hingedly connected thereto.

FIGS. 7*a* and 7*b* show yet another embodiment of the present invention. Details already shown and described in other embodiments have been omitted for clarity and to highlight differences between embodiments. As above, a terminating circuit 14 is incorporated in a circuit support housing 10. Circuit support housing 10 is coupled to mounting flange 70. A screw hole 72 is provided in mounting flange 70 as a simple and convenient method of attaching circuit support housing to a suitable surface near cable jack 27, such as wall plate 16. In this case, a screw (not shown) connects mounting flange 70, through screw hole 72, to one of screw recesses 26 on wall plate 16.

Flange 70 is preferably constructed of a material that is at least somewhat resilient, such as neoprene or another suitable plastic. Circuit support housing 10 and mounting flange 70 can alternatively be molded as a single piece. The resilient mounting flange 70 is flexible so that circuit support housing can be removed from and rotated in an arc away from cable jack 27 (direction labeled a). In this manner, the flexible mounting flange 70 acts as a hinge-like connection between circuit support housing 10 and wall mounting plate 16. Since mounting flange 70 is constructed of a resilient material having memory, circuit support housing 10 (and thus terminating circuit 14) is biased towards a self-terminating position with cable jack 27.

The embodiment shown in FIGS. 7*a* and 7*b* does not have to be used in a self-terminating mode of operation. In that case, mounting flange 70 does not need to be made from a resilient material. The circuit support housing 10 can be removed from cable jack 27 (in the direction labeled a) and then rotated clockwise or counterclockwise about screw hole 72 (or other point of connection) until circuit support housing 10 is to one side of cable jack 27. In this position cable jack 27 remains open and the apparatus is not self-terminating. However, since terminating circuit 14 is still attached to wall plate 16, terminating circuit 14 cannot become lost or misplaced. Additionally, since terminating circuit 14 is attached to wall plate 16, it is easily seen and acts as a reminder to terminate jack 27 whenever a cable is disconnected from the jack. To terminate the cable jack 27, circuit support housing 10 is merely moved back into position and place over jack 27.

The inventions set forth above are subject to many modifications and changes without departing from the spirit, scope or essential characteristics thereof. The embodiments explained above should be considered in all respects as being illustrative rather than restrictive of the scope of the inventions, as defined in the appended claims. Accordingly, while the present inventions have been described in connection with what is presently considered the most practical and preferred embodiments, the inventions are not to be limited to the disclosed embodiments. To the contrary, the inventions are intended to cover various modifications and equivalent arrangements included within the spirit and scope of the appended claims.

I claim:

1. An apparatus for terminating a coaxial connector having a central coaxial conductor surrounded by a conductive housing and coupled to a wall plate, the apparatus comprising:

(a) a circuit support housing;

(b) a terminating circuit carried by the circuit support housing and structured to terminate a signal carried by a coaxial connector; and (c) a moveable coupling structured to connect the circuit support housing to the wall plate and allow the circuit support housing to be moved between a terminating position relative to a coaxial connector and a non-terminating position.

2. An apparatus in accordance with claim 1 wherein the circuit support housing comprises a body having a circuit support mounting surface proximate a first end.

3. An apparatus in accordance with claim 2 wherein the moveable coupling comprises a hinge formed between an area proximate a second end of the circuit support housing and the wall plate.

4. An apparatus in accordance with claim 1 wherein the terminating circuit includes a resistor coupled between a conductive shield and a contact, and wherein the contact and the conductive shield are configured so that, when the circuit support housing is placed in the terminating position, the contact electrically connects to the central coaxial conductor of the coaxial connector and the conductive shield electrically connects to the coaxial connector conductive housing.

5. An apparatus in accordance with claim 4 wherein the circuit support housing comprises a body having a hollow portion proximate a first end of the circuit support housing, the hollow portion configured to retain the terminating circuit, and wherein the moveable coupling is formed proximate a second end of the housing.

6. An apparatus in accordance with claim 5 wherein the circuit support housing includes a frictional gripping surface proximate the first end of the circuit support housing.

7. An apparatus in accordance with claim 1 wherein the moveable coupling comprises:

(a) a post that extends from an interior wall of the circuit support housing; and (b) a mounting tab adapted to be carried by the wall plate and configured to rotatably retain the posts so that the circuit support housing can be moved between terminating and non-terminating positions.

8. An apparatus in accordance with claim 7 wherein the mounting tab includes an opening that is sized to allow the post of the circuit support housing to snap-fit and rotate therein.

9. An apparatus in accordance with claim 1 wherein the terminating circuit includes a circuit element designed to approach the characteristic impedance of the coaxial connector and that is structured to provide an electrical connection between the central coaxial conductor and the conductive housing of the coaxial connector when the circuit is located in the terminating position.

10. An apparatus for terminating a coaxial connector having a central coaxial conductor surrounded by a conductive housing, the apparatus comprising:

(a) a mounting plate;

(b) a support housing coupled to the mounting plate and movable between a terminating position and a non-terminating position;

(c) a terminating circuit carried by the support housing and structured to terminate a signal carried by a coaxial connector, the terminating circuit designed to approach the characteristic impedance of the coaxial connector; and (d) wherein the terminating circuit includes a circuit element structured to provide an electrical connection between the central coaxial conductor and the conductive housing of the coaxial connector when the support housing is located in the terminating position, but does not provide an electrical connection between the central coaxial conductor and the conductive housing of the coaxial connector when the support housing is located in a nonterminating position.

11. The apparatus of claim 10 wherein the support housing is normally biased in the terminating position.

12. The apparatus of claim 10 wherein the terminating circuit comprises:

(a) a first contact structured to provide an electrical connection with the cylindrical conductive housing of the coaxial connector;

(b) a second contact structured to provide an electrical connection with the central coaxial conductor of the coaxial connector; and (c) a resistor coupled between the first and second contacts and designed to approach the characteristic impedance of the coaxial connector.

13. The apparatus of claim 12 further comprising a circuit support housing having a hollow region proximate a first end thereof and configured to retain the terminating circuit.

14. The apparatus of claim 13 wherein the first electrical contact comprises a conductive shield formed into a substantially cupped shape that is retained within the hollow region of the circuit support housing.

15. The apparatus of claim 14 wherein the resistor is electrically connected at a first end to the conductive shield.

16. The apparatus of claim 15 wherein the second electrical contact comprises a conductive tip electrically coupled to a second end of the resistor.

17. The apparatus of claim 16 wherein the circuit support housing is biased in a self-terminating position that causes the conductive shield to electrically contact the conductive housing of the coaxial connector and the conductive tip to electrically contact the central coaxial conductor of the coaxial connector.

18. The apparatus of claim 17 wherein the circuit support housing includes a frictional gripping surface provided on the outer surface of the housing proximate the first end thereof.

19. The apparatus of claim 16 further comprising a hinge formed between mounting plate and a region proximate a second end of the support housing.

20. The apparatus of claim 19 wherein the hinge comprises:

(a) posts that extend from interior walls of the housing; and (b) mounting tabs carried by the mounting plate and configured to rotatably retain the posts so that housing can be moved between terminating and non-terminating positions.

21. An adaptor for movably coupling a terminating circuit support housing to a cable wall plate surrounding a cable jack, comprising:

(a) a first surface having an opening sized to slip over and be retained by the cable jack; and (b) at least one mounting tab extending outward from the first surface and configured to rotatably retain the circuit support housing.

22. The adapter of claim 21 wherein the adapter rotatably retains the circuit support housing so that the circuit support housing can be selectively moved on and off the cable jack.

23. The adapter of claim 22 wherein the mounting tabs retain the circuit support housing at a first end thereof so that a second end of the circuit support housing can be selectively raised or lowered onto the cable jack.

24. The adapter of claim 23 further comprising a frictional gripping surface on the circuit support housing.

25. The adapter of claim 23 further comprising a post that extends from an interior wall of the circuit support housing and an opening in the mounting tab that is sized to allow the post of the circuit support housing to snap-fit and rotate therein.

26. The adapter of claim 23 further comprising a terminating circuit supported by the circuit support housing and structured to terminate a signal carried by a coaxial connector, the circuit comprising:

(a) a conductive shield sized to fit over and electrically couple to a conductive housing of a cable jack;

(b) a circuit element coupled to the conductive shield and structured to approach the characteristic impedance of a coaxial cable; and (c) an electrical contact sized to fit within a cable jack and electrically couple to a central coaxial conductor of the cable jack.

* * * * *